US006314615B1

(12) United States Patent
Wolda

(10) Patent No.: US 6,314,615 B1
(45) Date of Patent: Nov. 13, 2001

(54) CLOSURE HINGE

(76) Inventor: Tiete O. Wolda, 12 Perivale Crescent, Toronto, Ontario (CA), M1J 2C1

( * ) Notice: Subject to any disclaimer, the term of this patent is extended or adjusted under 35 U.S.C. 154(b) by 0 days.

(21) Appl. No.: 09/566,724

(22) Filed: May 9, 2000

Related U.S. Application Data

(63) Continuation-in-part of application No. 08/941,111, filed on Sep. 30, 1997, now abandoned, and a continuation-in-part of application No. 08/980,620, filed on Dec. 1, 1997, now abandoned.

(51) Int. Cl.[7] ..... E05D 3/10

(52) U.S. Cl. ..... 16/367; 16/366; 16/368; 296/146.12

(58) Field of Search ..... 16/368, 365, 366, 16/367; 296/146.11, 146.12, 76; 49/246, 248, 249

(56) References Cited

U.S. PATENT DOCUMENTS

| | | | | |
|---|---|---|---|---|
| Re. 21,081 | | 5/1939 | Horst et al. . | |
| 1,100,684 | * | 6/1914 | Stoakes | 16/367 |
| 1,313,726 | * | 8/1919 | Niclo | 16/367 |
| 1,857,847 | | 5/1932 | Heinemann . | |
| 1,887,549 | | 11/1932 | Ervin . | |
| 1,938,643 | | 12/1933 | Smith . | |
| 2,071,070 | * | 2/1937 | Horst | 16/367 |
| 2,085,616 | | 6/1937 | Voge . | |
| 2,142,558 | | 1/1939 | Dumelin . | |
| 2,178,908 | | 11/1939 | Hudson . | |
| 2,225,178 | * | 12/1940 | Nicholson | 16/367 |
| 3,103,352 | | 9/1963 | Steffen . | |
| 3,956,793 | | 5/1976 | Jewell . | |
| 4,692,964 | | 9/1987 | DeBruyn . | |
| 5,419,012 | | 5/1995 | Lewis . | |
| 5,560,728 | | 10/1996 | McFadden . | |

FOREIGN PATENT DOCUMENTS

| | | | | |
|---|---|---|---|---|
| 524143 | | 7/1940 | (GB) . | |
| 516223 | * | 12/1939 | (GB) | 16/367 |

OTHER PUBLICATIONS

Mechanisms & Mechanical Devices Sourcebook, Nicholas P. Chironis, McGraw–Hill, Inc., 1991, various pp. (7).

1997 Service Manual GMP/97–WPB–1, W Platform, "1997 Pontiac Grand Prix, Buick Centruy and Regal Service Manual" 1996 General Motors Corp., Information date is Sep. 19, 1996 (4 pages).

* cited by examiner

*Primary Examiner*—Chuck Y. Mah
(74) *Attorney, Agent, or Firm*—Parkhurst & Wendel, LLP

(57) ABSTRACT

A multiaxis closure hinge for pivotally mounting a closure panel adjacent to an opening in a body to rotate about a point remote from the hinge between a closed position over the opening and an open position disposed apart from the opening is disclosed. The hinge comprises a body pintle and a panel pintle, each, having an inner and an outer end, each inner end having an inner axis, each outer end having an outer axis a body bearing mount at the outer end of the body pintle for pivotally mounting the body pintle to the body for rotation about a first axis; a bearing mount at the outer end of the panel pintle for pivotally mounting the panel pintle to the panel for rotation about a second axis; and a coupling block for rotatably coupling the inner ends of the body pintle and panel pintle together in fixed angled relation to one another to rotate, one in relation to the other, about a third axis disposed substantially coincident to the inner axis of a respective one of the pintles, and, with respect to the first axis and second axis, in non-congruent angled relation; wherein the first, second and third axes intersect at the point during rotation between the open and closed positions.

10 Claims, 5 Drawing Sheets

CLOSURE HINGE

RELATED APPLICATIONS

This application is a continuation-in-part of application Ser. No. 08/941,111 filed Sep. 30, 1997 now abandoned and a continuation-in-part of application Ser. No. 08/980,620 filed Dec. 1, 1997 now abandoned.

TECHNICAL FIELD

The invention is directed to a multiaxis closure hinge with all axes converging at a single remote pivot point, the hinge being assembled from standard mounting and pivot blocks together with bent pintle rods such that adaptations for various geometries can be easily accommodated by simple modifications to the pintle rod geometry alone.

BACKGROUND OF THE ART

Closure hinges for vehicles, cabinets and the like involve mounting one end of the hinge to a body and another end to a hood, door or similar moveable panel. The invention will be herein described in respect of a vehicle trunk hood as an example, however it will be understood that the invention is applicable to any number of hinge applications too numerous to specifically mention.

In respect of motor vehicles, due to the costs of tooling, it is preferable to standardize as many parts as possible. Mass production of identical parts that can be utilized in a large number of different vehicles is definitely the most cost effective way in which to manufacture car parts.

On the other hand, especially in respect of the exterior body of a passenger vehicle, major styling modifications are made to the vehicle bodies annually as a norm. To accommodate styling changes to a hinged portion of the car body, such as the trunk hood area, it is often necessary to modify the geometry of the hinge. Hinge redesign results in the need for retooling and the attendant increase in manufacturing costs.

As well, the complex shapes of hoods and the need for clearance to avoid interference damage often dictate that hoods rotate about an axis or point remote from the vehicle body. In such cases, complex multiaxis closure hinges may be used; however, to date, the manufacturing and assembly costs involved in production of such multiaxis hinges is often prohibitive.

Commonly used hinges for vehicle trunk hoods include gooseneck hinges and multiple bar hinges. A significant disadvantage of the gooseneck hinge is that portions of the hinge extend into the cargo area, reducing available space and exposing the cargo and hinge to damage. Interference with the cargo can easily tip the trunk hood and disturb the weather seal. The multibar hinge is more complex and relatively expensive to produce, however the intrusion into the cargo area is improved over the gooseneck hinge.

Lateral stability of prior art hinges is also a concern, and is usually dealt with by providing rigid connection to the body and to the hood, and by increasing the lateral structural resistance of the hinge. However, such measures also increase the material used and labour involved in installation.

Ideally, a hinge which does not intrude into the cargo space is desirable.

DISCLOSURE OF THE INVENTION

The invention provides a multiaxis closure hinge for pivotally mounting a closure panel adjacent to an opening in a body to rotate about a point remote from the hinge between a closed position over the opening and an open position disposed apart from the opening.

The comprises two pintles, being a body pintle and a panel pintles, each of said two pintles, having an inner end and an outer end, each inner end having an inner axis and each outer end having an outer axis with body mount means at the outer end of the body pintle for pivotally mounting the body pintle to the body for rotation about a first axis, and panel mount means at the outer end of the panel pintle for pivotally mounting the panel pintle to the panel for rotation about a second axis; and coupling means for rotatably coupling the inner ends of the body pintle and panel pintle together in fixed angled relation to one another to rotate about a third axis disposed substantially coincident to the inner axis of a respective one of the pintles, and, with respect to the first axis and second axis, in non-congruent angled relation; wherein the first, second and third axes intersect at the point during rotation between the open and closed positions.

In a preferred embodiment the body pintle and panel pintle comprise elongate rods wherein inner axis of the body pintle is disposed at a first predetermined angle relative to the outer axis of the body pintle and wherein the inner axis of the panel pintle is disposed at a second predetermined angle relative to the outer axis of the panel pintle. The pintles include retainer means for axially securing the outer end of the body pintle to the body mount means, the outer end of the panel pintle to the panel mount means, and the inner end of the panel pintle to the coupling means, said retainer means preferably comprising press fit retainer bushings with the pintles preferably comprising bent cylindrical members.

Preferably, the body mount means preferably comprises a flanged body bearing mount. The panel mount means preferably comprises a flanged panel bearing mount, and the coupling means preferably comprises a coupling block adapted for coupling the inner axes at in fixed acutely angled relation, with the inner axis of the panel pintle coincident with the third axis, and for fixing the inner end of the body pintle to the coupling block to prevent relative rotation therebetween.

Preferably, each component of the hinge, (i.e.: body pintle, body mount means, panel pintle, panel mount means and coupling means) has a plane of symmetry enabling the hinge to be used for left and right installation. Therefore, it is not necessary to fabricate and stock left and right versions of the same component, thereby reducing costs and production time.

As a result of the novel structure, standard components can be mass produced to reduce costs and any modifications required to suit a particular application can be accomplished merely by redesigning the bent cylindrical pintle rods. Significant retooling costs can thus be avoided.

The mount means panel, body mounts means and coupling means can remain standard despite changes in the hinge geometry required for a particular application. To change the hinge geometry, the designer need merely redesign the geometry of the pintle rods.

Since the pintles are constructed of solid cylindrical metal stock, different lengths and bends are easily made with relatively inexpensive tooling. Compared to retooling for stamped sheet metal hinge components of the prior art, the retooling required to fabricate a bent solid rod is significantly lower in cost and skill level.

The lateral stability of the hinge in all positions is far superior to the prior art gooseneck and multibar hinges since the angular orientation of the pintles result in a diagonal strut or scissors-like bracing structure. The hinge co-operates with means to maintain the trunk hood in an open position, such as pneumatic cylinders or torsion bars, as is well-known in the art.

The hinge is compact since it folds upon, itself and is small enough to be accommodated in the gutter of a vehicle body adjacent the trunk hood. Therefore, the hinge does not intrude into the luggage area, avoiding the problems associated with the prior art.

The geometry of the hinge is preferably maintained, such that the three axes of rotation intersect at a virtual hinge point, but do not define a single plane in operation. In other words, the hinge remains in a flexed orientation to avoid dead head instability or toggling action, which would result if all three axes were allowed to move to a coplanar position.

Further details of the invention and of its advantages will be apparent from the detailed description and drawings included below.

BRIEF DESCRIPTION OF THE DRAWINGS

In order that the invention may be readily understood, a preferred embodiment of the invention will be described by way of example, with reference to the accompanying drawings wherein.

DETAILED DESCRIPTION OF A PREFERRED EMBODIMENT

Figure 1:
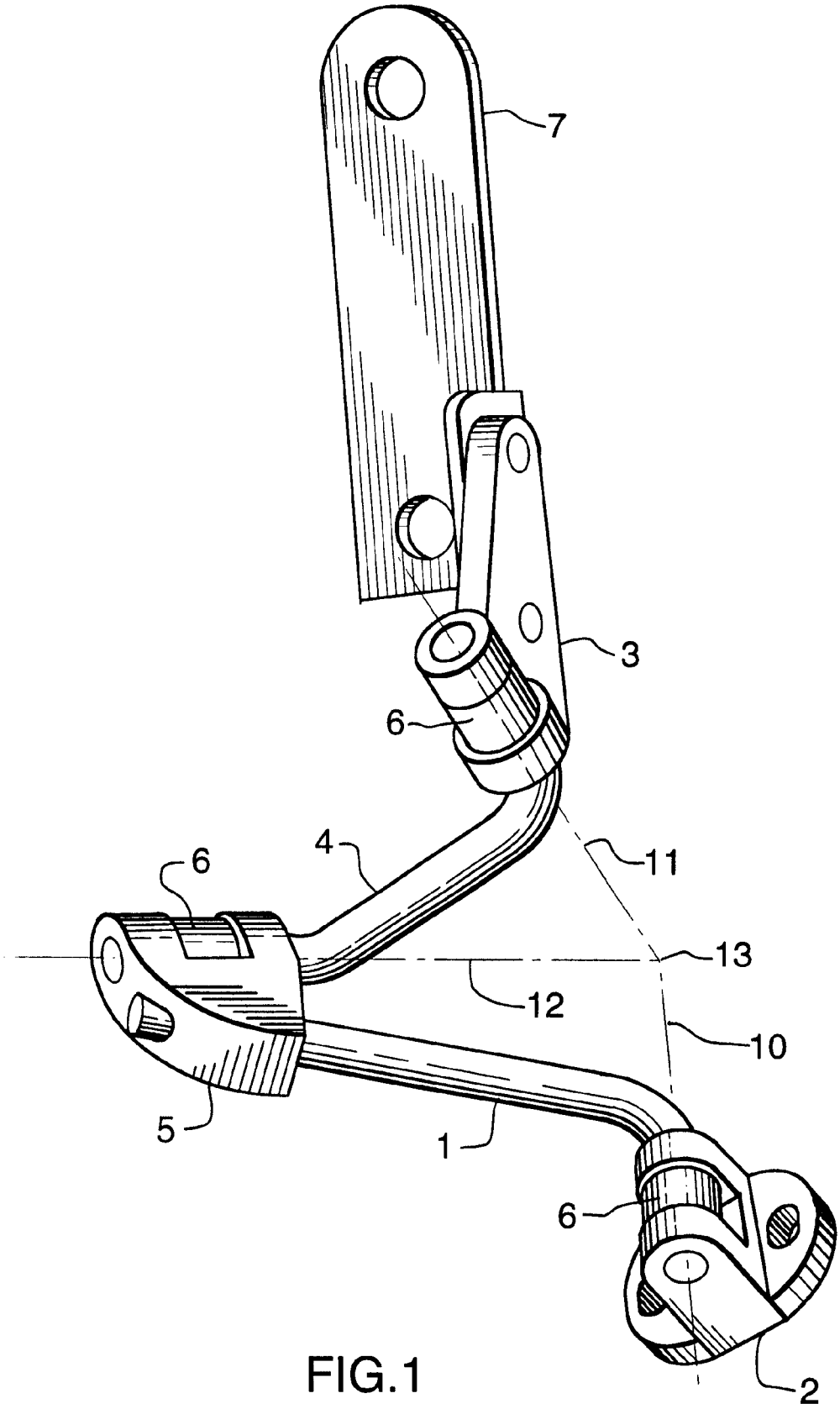
FIG. 1 is a perspective view of a multiaxis hinge in an open position according to the invention showing a lower body mount means and an upper panel mount means with a central coupling means joining the body and panel pintles to rotate about three axes which intersect at a point remote from the hinge.
Figure 2:
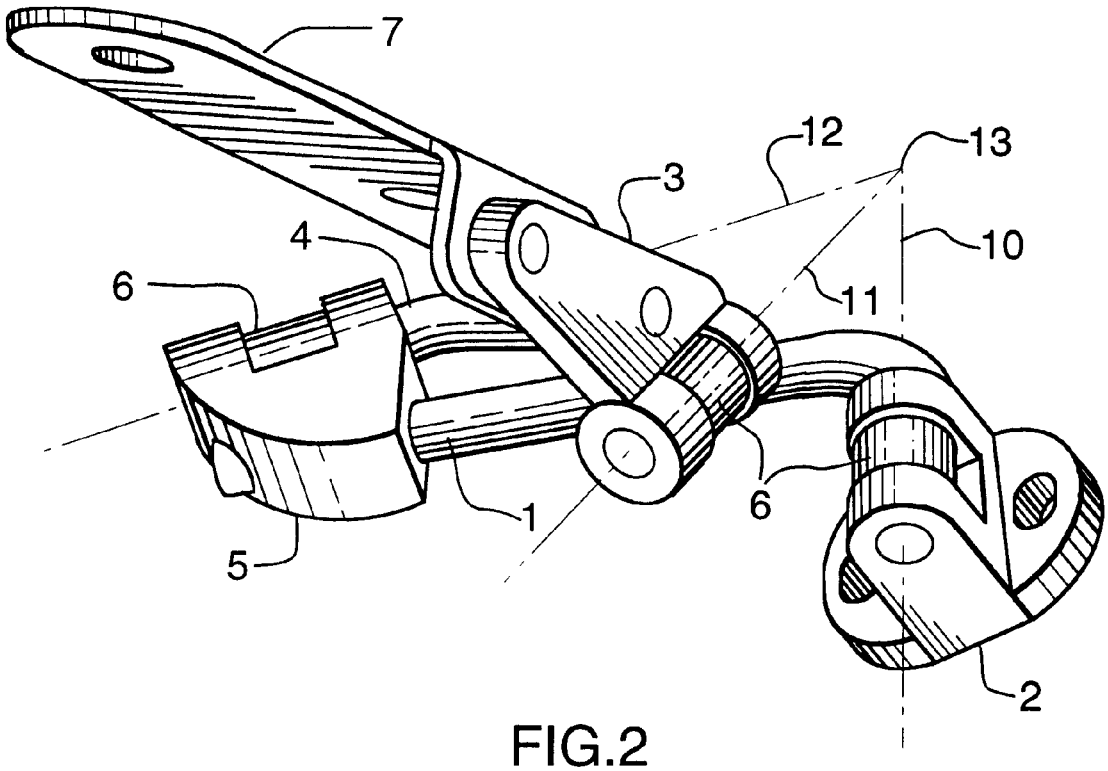
FIG. 2 is a like perspective view in the closed position showing the compact collapsing feature of the hinge, such that it can be accommodated within the gutter of a vehicle trunk hood so as to produce minimal interference with the luggage area.

With reference to FIG. 1, the drawing shows a multiaxis closure hinge assembled from standard modular components as follows: body pintle 1; body mount means 2; panel mount means 3; panel pintle 4; and a coupling means in the form of coupler 5.

The body pintle 1 has an inner end and an outer end, the inner end having an inner axis and the outer end having an outer axis, with the body mount means 2 at the outer end for pivotally mounting the body pintle 1 to the body (not shown) for rotation about a first axis 10.

The panel pintle 4 also has an inner end and an outer end, the inner end having an inner axis and the outer end having an outer axis, with panel mount means 3 at the outer end for pivotally mounting the panel pintle 4 to the panel (not shown) for rotation about a second axis 11.

Coupling means 5 is provided for rotatably coupling the inner ends of the body pintle 1 and panel pintle 4 together in fixed angled relation to one another to rotate one in relation to the other about a third axis 12 disposed substantially coincident to the inner axis of a respective one of the pintles, 1, 4, and, with respect to the first axis 10 and second axis 11, in non-congruent angled relation.

The first axis 10, second axis 11 and third axis 12 intersect at a point 13 remote from the hinge during rotation between the open and closed positions.

Figure 3:
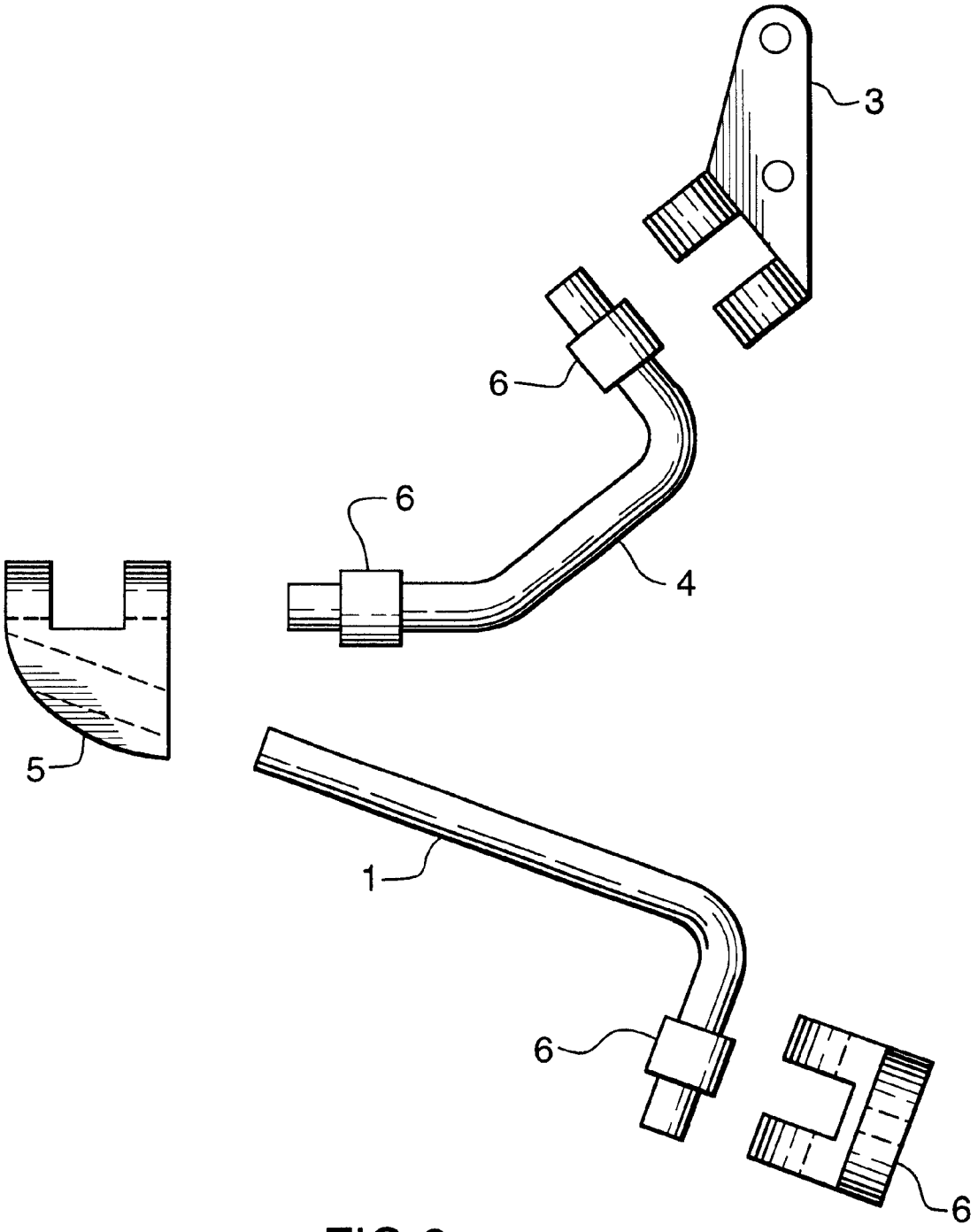
FIG. 3 is an exploded view showing the symmetrical components of the hinge which can be utilized for left and right hinges interchangeably.

For simplicity of manufacture, preferably the body pintle 1 and panel pintle 4 comprise elongate rods that are bent such that the inner axis of the body pintle 1 is disposed at a first predetermined angle relative to outer axis of the body pintle 1, and wherein the inner axis of the panel pintle 4 is disposed at a second predetermined angle relative to the outer axis of the panel pintle 4, as best shown in FIG. 3.

Preferably, the body pintle 1 and panel pintle 4 comprise bent cylindrical members. Significant geometry modifications can be made to the hinge merely by bending the pintles 1, 4 to different orientations. In combination with varying the length of the pintles 1,4, the designer can modify the hinge significantly without altering the design of standard components 2, 3, and 5.

Preferably, the body pintle 1 and panel pintle 4 include retainer means 6 for axially securing the outer end of the body pintle 1 to the body mount means .2, the outer end of the panel pintle 4 to the panel mount means 3, and the inner end of the panel pintle 4 to the coupling means 5, which retainer means 6 preferably each comprises a retainer bushing 6 press fit on to the pintles 1, 4 during assembly.

In the preferred embodiment illustrated, the body mount means 2 comprises a standard flanged body bearing mount, whereas the panel mount means 3 is a standard flanged panel bearing mount to enable easy connection to a standard passenger vehicle trunk hood bracket 7.

The coupling means 5 in the preferred embodiment illustrated comprises a solid coupling block adapted for coupling the inner end axes of the pintles 1, 4 in fixed acutely angled relation with the inner axis of the panel pintle 4 coincident with the third axis 12, and for fixing the body pintle 1 to the coupling block 5 to prevent relative rotation therebetween. Preferably, the inner end of the body pintle 1 is or press fit, in a bore in the coupling block 5 to achieve such fixation of the body pintle 1 to the coupling block 5, to achieve such fixation of the body pintle 1 to the coupling block 5.

As best seen in FIG. 3, each component of the hinge, including the body pintle 1, body mount means 2, panel pintle 4, panel mount means 3 and coupling means 5, has a plane of symmetry to enable standard components to be used for both left and right hinges. In general, as illustrated the plane of symmetry is coplanar with the respective axis of rotation 10, 11, or 12.

The hinge may co-operate with means to maintain a vehicle trunk hood in an open position, such as pneumatic cylinders or torsion bars. The closure may be activated by displacement assisting devices that control the speed or strength of the panel movement.

Figure 4:
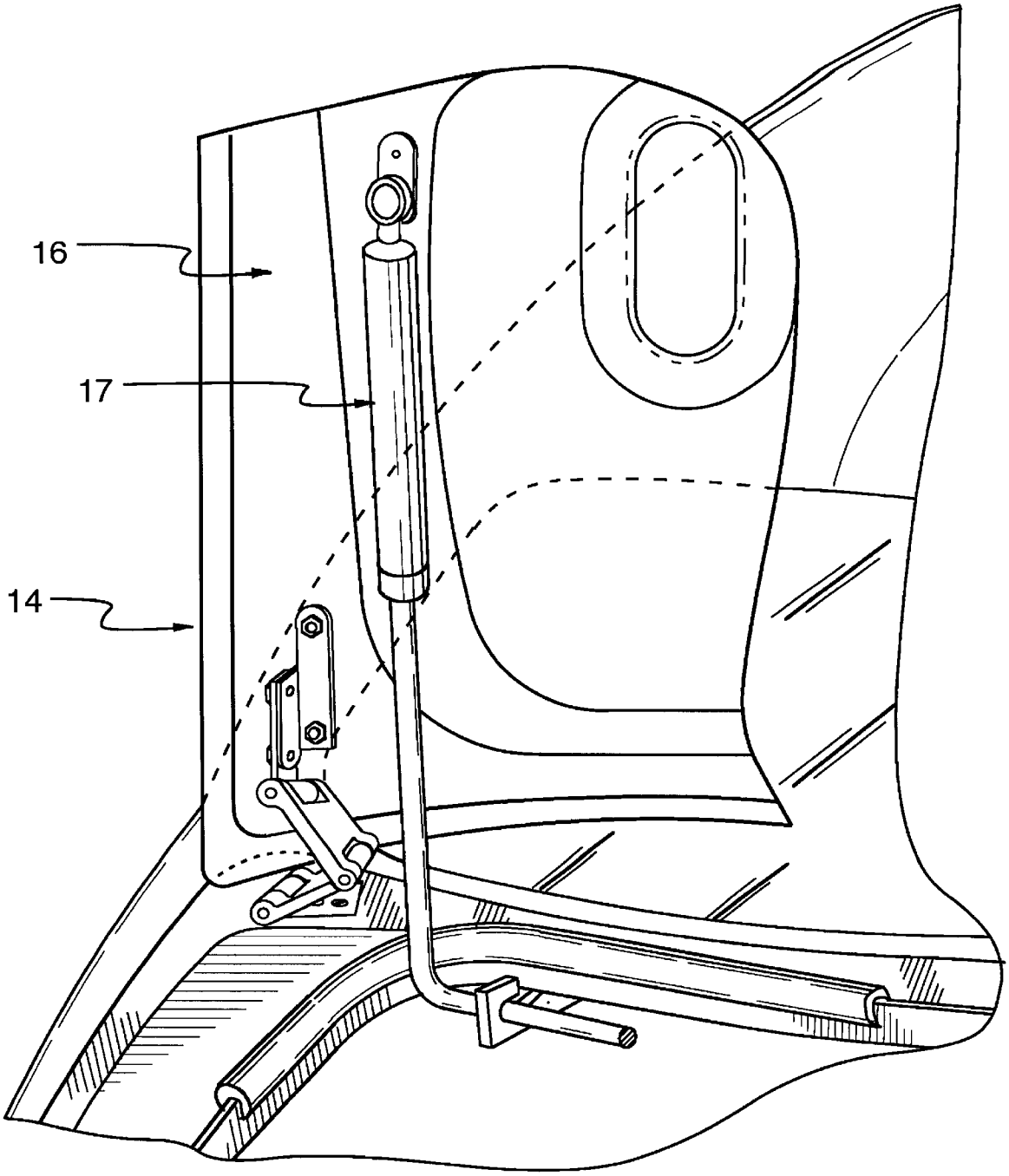
FIG. 4 is a perspective view showing a vehicle body opening with a hinge constructed according to the present invention.
Figure 5:
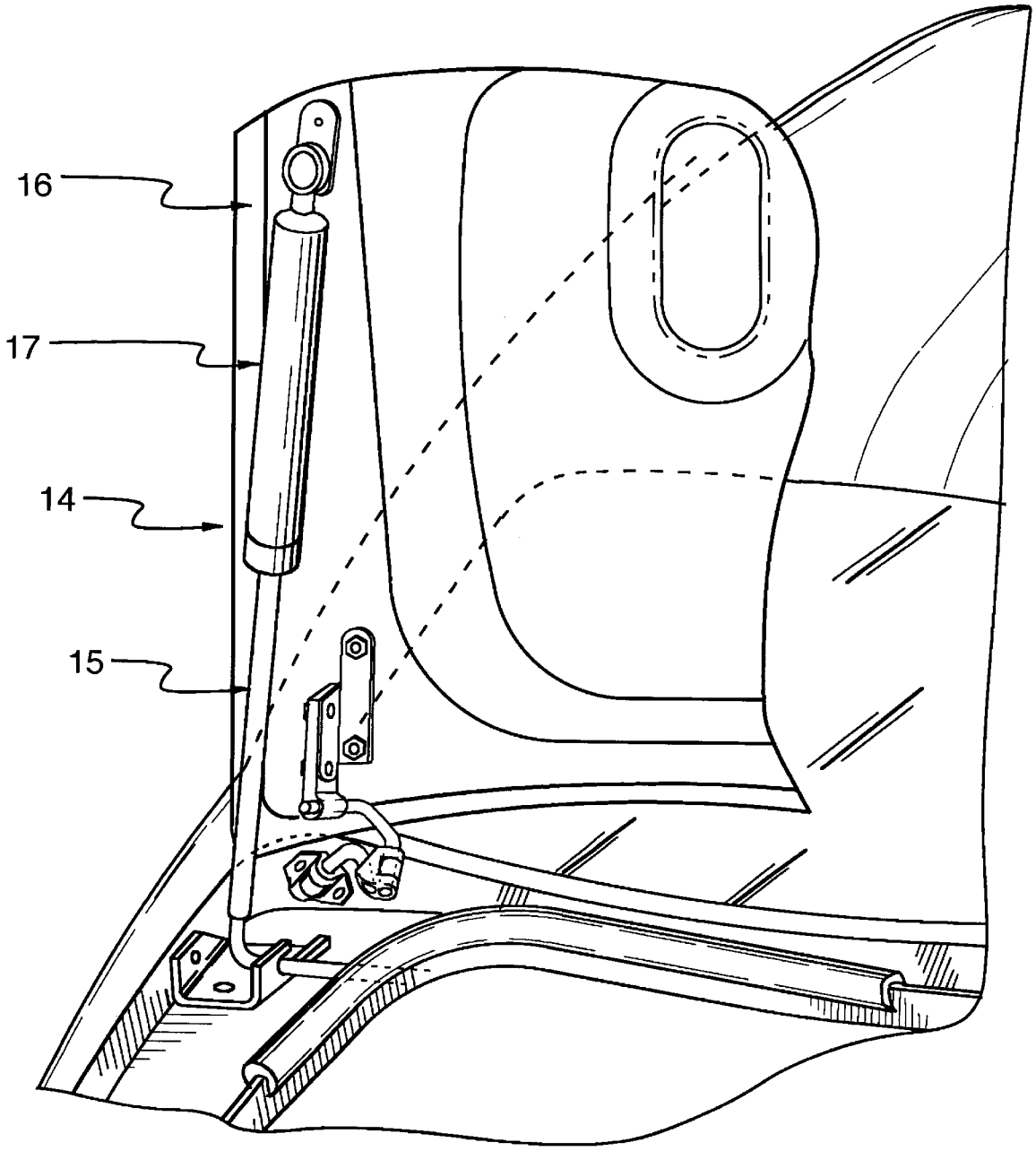
FIG. 5 is another perspective view showing a vehicle body opening with a hinge constructed according to the present invention.

As shown with FIGS. 4 and 5, an assistor 14 may be constructed as a torsion spring 15 that biases the trunk lid 16 upwardly to an open position. The end of the spring 15 may be coupled to the lid 16 through a telescoping device 17 that adjusts for the change in length of the spring end mount as the panel travels its hinge path. Preferably, a cylinder carrying a piston attached to the plunger end of the torsion rod may include gas or viscous pressure to limit the speed and the force at which the panel is twisted open as the plunger end withdraws from or retreats into the cylinder. The movement may also controlled by twisting in the end portion of the torsion spring 15. Of course, other spring mechanisms can be used with the hinge structure of the present invention, but the torsion spring provides a simple structure that saves space and weight in the vehicle body and improves the available access area of the opening as well as the storage space available within the compartment exposed to the access opening.

Although the above description and accompanying drawings relate to a specific preferred embodiment as presently contemplated by the inventor, it will be understood that the invention in its broad aspect includes mechanical and functional equivalents of the elements described and illustrated. For example, pintles of various cross-sections can be used in place of the cylindrical cross-section pintles shown in the figures. Moreover, to lessen production costs, such pintles may have a generally flat profile, so as to be capable of production from flat metal stock, utilizing conventional stamping techniques in widespread use in the auto parts industry. In such instance, it may also be desirable to form one or more of the ends of the pintles with stamped ear flanges shaped and dimensioned to operatively interfit with mating ear flanges on adjacent components of the hinge, in which case a separate hinge pin would be required to pivotally connect the two adjacent components, in the same general manner as a conventional door hinge The embodiments of the invention in which an exclusive property or privilege is claimed are defined as follows:

1. A multiaxis closure hinge for pivotally mounting a closure panel adjacent to an opening in a body to rotate about a point remote from the hinge between a closed position over the opening and an open position disposed apart from the opening, the hinge comprising:

two pintles, comprising a body pintle and a panel pintle, with each of said two pintles having an inner end and an outer end, each inner end having an inner axis and each outer end having an outer axis;

a body mount means positioned at the outer end of the body pintle for pivotally mounting the body pintle to the body for rotation about a first axis;

a panel mount means positioned at the outer end of the panel pintle for pivotally mounting the panel pintle to the panel for rotation about a second axis; and coupling means for rotatably coupling the inner ends of the body pintle and panel pintle together in fixed angled relation to one another, to rotate one in relation to the other about a third axis disposed substantially coincident to the inner axis of a respective one of the pintles, and, with respect to the first axis and second axis, in non-congruent angled relation;

wherein the first, second and third axes intersect at the point during rotation between the open and closed positions.

2. A hinge according to claim 1 wherein the body pintle and panel pintle comprise elongate rods wherein the inner axis of the body pintle is disposed at a first predetermined angle relative to the outer axis of the body pintle, and wherein the inner axis of the panel pintle is disposed at a second predetermined angle relative to the outer axis of the panel pintle.

3. A hinge according to claim 2 wherein the body pintle and panel pintle comprise bent cylindrical members.

4. A hinge according to claim 3 wherein the body pintle and panel pintle include retainer means for axially securing the outer end of the body pintle to the body mount means, the outer end of the panel pintle to the panel mount means and the inner end of the panel pintle to the coupling means.

5. A hinge according to claim 4 wherein the retainer means comprise retainer bushings.

6. A hinge according to claim 5 wherein the body mount means comprises a flanged body bearing mount, and wherein the panel mount means comprises a flanged panel bearing mount.

7. A hinge according to claim 6 wherein the coupling means comprises a coupling block adapted for coupling the inner axes in fixed acutely angled relation, with the inner axis of the panel pintle coincident with the third axis, and for fixing the body pintle to the coupling block to prevent relative rotation therebetween.

8. A hinge according to claim 1 wherein each of said body pintle, said body mount means, said panel pintle, said panel mount means, and said coupling means has a plane of symmetry.

9. In combination, (1) a means for assisting displacement between one point and another point and (2) a multiaxis closure hinge for pivotally mounting a closure panel adjacent to an opening in a body to rotate about a point remote from the hinge between a closed position over the opening and an open position disposed apart from the opening, the hinge comprising:

two pintles, comprising a body pintle and a panel pintle, with each of said two pintles having an inner end and an outer end, each inner end having an inner axis and each outer end having an outer axis;

a body mount means positioned at the outer end of the body pintle for pivotally mounting the body pintle to the body for rotation about a first axis;

a panel mount means positioned at the outer end of the panel pintle for pivotally mounting the panel pintle to the panel for rotation about a second axis; and coupling means for rotatably coupling the inner ends of the body pintle and panel pintle together in fixed angled relation to one another, to rotate one in relation to the other about a third axis disposed substantially coincident to the inner axis of a respective one of the pintles, and, with respect to the first axis and second axis, in non-congruent angled relation;

wherein the first, second and third axes intersect at the point during rotation between the open and closed positions.

10. The combination of claim 9, wherein said means for assisting displacement is a torsion bar.

* * * * *

UNITED STATES PATENT AND TRADEMARK OFFICE

CERTIFICATE OF CORRECTION

PATENT NO. : 6,314,615 B1
DATED : November 13, 2001
INVENTOR(S) : Tiete O. Wolda It is certified that error appears in the above-identified patent and that said Letters Patent is hereby corrected as shown below:

Title page,
Item [63], insert:

-- Foreign Application Priority Data
October 20, 1997 (CA)..... 2,218,777 --.

Signed and Sealed this

Twenty-seventh Day of August, 2002

*Attest:*

*Attesting Officer*

JAMES E. ROGAN
*Director of the United States Patent and Trademark Office*